US008230707B2

(12) United States Patent
Hung et al.

(10) Patent No.: US 8,230,707 B2
(45) Date of Patent: Jul. 31, 2012

(54) SECURITY SYSTEM WITH LOCK INTERFACE MEMBER WITH MULTIPLE APERTURES

(75) Inventors: John Hung, Vancouver (CA); Ryan White, San Francisco, CA (US)

(73) Assignee: ACCO Brands Corporation, Lincolnshire, IL (US)

( * ) Notice: Subject to any disclaimer, the term of this patent is extended or adjusted under 35 U.S.C. 154(b) by 194 days.

(21) Appl. No.: 12/599,844

(22) PCT Filed: May 21, 2008

(86) PCT No.: PCT/US2008/064382

§ 371 (c)(1), (2), (4) Date: Nov. 12, 2009

(87) PCT Pub. No.: WO2008/147818

PCT Pub. Date: Dec. 4, 2008

(65) Prior Publication Data

US 2010/0139337 A1 Jun. 10, 2010

Related U.S. Application Data

(60) Provisional application No. 60/940,318, filed on May 25, 2007.

(51) Int. Cl.
*E05B 69/00* (2006.01)

(52) U.S. Cl. ..... 70/58; 70/14; 248/551; 361/679.4

(58) Field of Classification Search ..... 70/14, 57, 70/58; 248/551–553; 361/679.4
See application file for complete search history.

(56) References Cited

U.S. PATENT DOCUMENTS

| | | | |
|---|---|---|---|
| 87,045 | A | 2/1869 | Holmes |
| 98,509 | A | 10/1869 | Petre |
| 285,074 | A | 9/1883 | Rhoades et al. |
| 505,299 | A | 9/1893 | Schneider |
| 606,734 | A | 7/1898 | Olmstead |
| 611,646 | A | 10/1898 | Parker |
| 786,842 | A | 4/1905 | Robeson |
| 881,364 | A | 3/1908 | Wheeler |
| 934,928 | A | 9/1909 | Michel |
| 942,537 | A | 12/1909 | Batdorf |
| 952,411 | A | 3/1910 | Billy |

(Continued)

FOREIGN PATENT DOCUMENTS

CA 454901 3/1949

(Continued)

OTHER PUBLICATIONS

Kablit Security System Catalog, pp. 7, 93, 1988. Computer and Office Equipment Security Catalog, 1990, Secure-It, Inc., 18 Maple Court, East Longmeadow, MA 01028.

(Continued)

*Primary Examiner* — Suzanne Barrett
(74) *Attorney, Agent, or Firm* — Kilpatrick Townsend & Stockton LLP

(57) ABSTRACT

A system is disclosed. It includes a portable electronic device comprising a lock interface member having a first aperture configured to engage with a first security apparatus and a second aperture configured to engage with a second security apparatus. At least one of the first security apparatus and the second security apparatus is engaged with the lock interface member.

6 Claims, 7 Drawing Sheets

U.S. PATENT DOCUMENTS

| | | | |
|---|---|---|---|
| 989,484 | A | 4/1911 | Campbell |
| 1,004,333 | A | 9/1911 | Alsterberg |
| 1,050,276 | A | 1/1913 | Johnson |
| 1,101,450 | A | 6/1914 | Kerry |
| 1,213,992 | A | 1/1917 | Wright |
| 1,387,442 | A | 8/1921 | Lee |
| 1,432,546 | A | 10/1922 | Gillom |
| 1,452,471 | A | 4/1923 | Kline |
| 1,470,937 | A | 10/1923 | Schou |
| 1,534,936 | A | 4/1925 | Fishchbach |
| 1,672,333 | A | 6/1928 | Miller |
| 1,786,511 | A | 12/1930 | Warren |
| 1,978,935 | A | 1/1933 | Douglas |
| 2,001,354 | A | 5/1935 | Smith |
| 2,102,583 | A | 12/1937 | Alberg |
| 2,109,109 | A | 2/1938 | Finch |
| 2,130,216 | A | 9/1938 | Zaninovich |
| 2,172,208 | A | 9/1939 | Kutrzon |
| 2,190,661 | A | 2/1940 | Hauer |
| 2,383,397 | A | 8/1945 | Lofquist |
| 2,405,400 | A | 8/1946 | Butterfiled |
| 2,435,876 | A | 2/1948 | De Swart |
| 2,469,874 | A | 5/1949 | Fetsko, Jr. |
| 2,480,662 | A | 8/1949 | McKinzie |
| 2,577,956 | A | 3/1950 | Elsberg |
| 2,530,560 | A | 11/1950 | Young |
| 2,594,012 | A | 4/1952 | Griffin |
| 2,660,084 | A | 11/1953 | Newman |
| 2,677,261 | A | 5/1954 | Jacobi |
| 2,729,418 | A | 1/1956 | Maynard |
| 2,800,090 | A | 7/1957 | Reid |
| 2,963,310 | A | 12/1960 | Abolins |
| 3,091,011 | A | 5/1963 | Campbell |
| 3,101,695 | A | 8/1963 | Honeyman, Jr. |
| 3,130,571 | A | 4/1964 | Neumann |
| 3,136,017 | A | 6/1964 | Preziosi |
| 3,171,182 | A | 3/1965 | Danehy |
| 3,174,384 | A | 3/1965 | Vanni |
| 3,200,694 | A | 8/1965 | Rapata |
| 3,211,408 | A | 10/1965 | Schaefer |
| 3,213,745 | A | 10/1965 | Dwyer |
| 3,220,077 | A | 11/1965 | Newcomer, Jr. et al. |
| 3,276,835 | A | 10/1966 | Hall |
| 3,380,268 | A | 4/1968 | Perrill |
| 3,469,874 | A | 9/1969 | Mercurio |
| 3,486,158 | A | 12/1969 | Soltysik et al. |
| 3,521,845 | A | 7/1970 | Sweda et al. |
| 3,590,608 | A | 7/1971 | Smyth et al. |
| 3,596,265 | A | 7/1971 | Garland |
| 3,625,031 | A | 12/1971 | Alley, III |
| 3,634,963 | A | 1/1972 | Hermann |
| 3,664,163 | A | 5/1972 | Foote |
| 3,722,239 | A | 3/1973 | Mestre |
| 3,727,934 | A | 4/1973 | Averbook et al. |
| 3,737,135 | A | 6/1973 | Bertolini |
| 3,754,420 | A | 8/1973 | Oellerich |
| 3,765,197 | A | 10/1973 | Foote |
| 3,771,338 | A | 11/1973 | Raskin |
| 3,772,645 | A | 11/1973 | Odenz et al. |
| 3,782,146 | A | 1/1974 | Franke |
| 3,785,183 | A | 1/1974 | Sander |
| 3,798,934 | A | 3/1974 | Wright et al. |
| 3,826,510 | A | 7/1974 | Halter |
| D232,416 | S | 8/1974 | Gazda et al. |
| 3,836,704 | A | 9/1974 | Coules |
| 3,859,826 | A | 1/1975 | Singer et al. |
| 3,866,873 | A | 2/1975 | Bohli |
| 3,875,645 | A | 4/1975 | Tucker et al. |
| 3,898,641 | A | 8/1975 | Banner |
| 3,905,570 | A | 9/1975 | Nieuwveld |
| 3,910,079 | A | 10/1975 | Gassaway |
| 3,910,081 | A | 10/1975 | Pender |
| 3,939,752 | A | 2/1976 | Koscik |
| 3,986,780 | A | 10/1976 | Nivet |
| 3,990,276 | A | 11/1976 | Shontz |
| 3,999,410 | A | 12/1976 | Hall |
| 4,003,228 | A | 1/1977 | Lievens et al. |
| 4,004,440 | A | 1/1977 | Dreyer |
| 4,007,613 | A | 2/1977 | Gassaway |
| 4,018,339 | A | 4/1977 | Pritz |
| 4,028,913 | A | 6/1977 | Falk |
| 4,028,916 | A | 6/1977 | Pender |
| 4,047,748 | A | 9/1977 | Whaley et al. |
| 4,055,973 | A | 11/1977 | Best |
| 4,057,984 | A | 11/1977 | Avaiusini |
| 4,065,083 | A | 12/1977 | Gassaway |
| 4,066,195 | A | 1/1978 | Dickler |
| 4,066,231 | A | 1/1978 | Bahner |
| 4,104,951 | A | 8/1978 | Leitner |
| 4,112,820 | A | 9/1978 | Conger et al. |
| 4,114,409 | A | 9/1978 | Scire |
| 4,118,902 | A | 10/1978 | Saxton |
| 4,123,922 | A | 11/1978 | Kuenstler |
| 4,131,001 | A | 12/1978 | Gotto |
| 4,212,175 | A | 7/1980 | Zakow |
| 4,223,542 | A | 9/1980 | Basseches |
| 4,252,007 | A | 2/1981 | Kerley |
| 4,263,833 | A | 4/1981 | Loudin |
| 4,300,371 | A | 11/1981 | Herwick et al. |
| 4,311,883 | A | 1/1982 | Kidney |
| 4,337,462 | A | 6/1982 | Lemelson |
| 4,391,110 | A | 7/1983 | Nielson |
| 4,394,101 | A | 7/1983 | Richer |
| 4,418,550 | A | 12/1983 | Hamilton |
| 4,419,034 | A | 12/1983 | DiMartino |
| 4,442,571 | A | 4/1984 | Davis et al. |
| 4,448,049 | A | 5/1984 | Murray |
| 4,462,233 | A | 7/1984 | Horetzke |
| 4,466,259 | A | 8/1984 | Osgood |
| 4,471,980 | A | 9/1984 | Hickman |
| 4,478,545 | A | 10/1984 | Mizusawa |
| 4,501,460 | A | 2/1985 | Sisler |
| 4,502,305 | A | 3/1985 | Bakker |
| 4,527,405 | A | 7/1985 | Renick et al. |
| 4,546,629 | A | 10/1985 | Hwang |
| 4,570,465 | A | 2/1986 | Bennett |
| 4,579,492 | A | 4/1986 | Kazino |
| 4,584,856 | A | 4/1986 | Petersdorff et al. |
| 4,586,843 | A | 5/1986 | Henge et al. |
| 4,593,273 | A | 6/1986 | Narcisse |
| 4,598,272 | A | 7/1986 | Cox |
| 4,603,829 | A | 8/1986 | Koike et al. |
| 4,610,587 | A | 9/1986 | Wollar |
| 4,616,490 | A | 10/1986 | Robbins |
| 4,620,182 | A | 10/1986 | Keifer |
| 4,640,106 | A | 2/1987 | Derman |
| 4,651,544 | A | 3/1987 | Hungerford |
| 4,653,297 | A | 3/1987 | Moorhouse |
| 4,654,640 | A | 3/1987 | Carll et al. |
| 4,655,057 | A | 4/1987 | Derman |
| 4,656,848 | A | 4/1987 | Rose |
| 4,667,491 | A | 5/1987 | Lokken et al. |
| 4,676,080 | A | 6/1987 | Schwarz |
| 4,680,949 | A | 7/1987 | Stewart |
| 4,685,312 | A | 8/1987 | Lakoski et al. |
| 4,691,891 | A | 9/1987 | Dionne |
| 4,692,968 | A | 9/1987 | Girard |
| 4,704,881 | A | 11/1987 | Sloop, Sr. |
| 4,733,840 | A | 3/1988 | D'Amore |
| 4,738,428 | A | 4/1988 | Themistos et al. |
| 4,741,185 | A | 5/1988 | Weinert et al. |
| 4,768,361 | A | 9/1988 | Derman |
| 4,770,583 | A | 9/1988 | Lindberg |
| 4,779,434 | A | 10/1988 | Derman |
| 4,785,291 | A | 11/1988 | Hawthorne |
| 4,801,232 | A | 1/1989 | Hempel |
| 4,804,943 | A | 2/1989 | Soleimani |
| 4,805,426 | A | 2/1989 | Dimmick et al. |
| 4,813,252 | A | 3/1989 | Ray |
| 4,826,193 | A | 5/1989 | Davis |
| 4,834,600 | A | 5/1989 | Lemke |
| 4,842,912 | A | 6/1989 | Hutter, III |
| 4,843,848 | A | 7/1989 | Igelmund |
| 4,856,304 | A | 8/1989 | Derman |
| 4,856,305 | A | 8/1989 | Adams |
| 4,858,455 | A | 8/1989 | Kuo |
| 4,862,716 | A | 9/1989 | Derman |

4,869,082 A 9/1989 Appelbaum
4,870,840 A 10/1989 Klein
4,878,045 A 10/1989 Tanaka et al.
4,893,488 A 1/1990 Klein
4,896,140 A 1/1990 Biever
4,907,111 A 3/1990 Derman
4,907,716 A 3/1990 Wankel et al.
4,918,952 A 4/1990 Lakoski et al.
4,924,683 A 5/1990 Derman
4,924,693 A 5/1990 College
4,938,040 A 7/1990 Humphreys, Jr.
4,959,635 A 9/1990 Wilson
4,959,979 A 10/1990 Filipow et al.
4,964,285 A 10/1990 Lakoski
4,966,511 A 10/1990 Lee
4,969,342 A 11/1990 Marchiori
4,978,265 A 12/1990 DeWan
4,979,382 A 12/1990 Perry
4,985,695 A 1/1991 Wilkinson et al.
4,986,097 A 1/1991 Derman
4,993,244 A 2/1991 Osman
5,001,460 A 3/1991 Basson
5,001,854 A 3/1991 Derman
5,010,748 A 4/1991 Derman
5,022,242 A 6/1991 Povilaitis
5,024,072 A 6/1991 Lee
5,027,627 A 7/1991 Derman
5,050,836 A 9/1991 Makous
5,052,199 A 10/1991 Derman
5,063,763 A 11/1991 Johnson
5,066,942 A 11/1991 Matsuo
5,067,151 A 11/1991 Inagaki
5,076,079 A 12/1991 Monoson
5,082,232 A 1/1992 Wilson
5,082,233 A 1/1992 Ayers et al.
5,099,663 A 3/1992 Dearstine
5,117,661 A 6/1992 Carl et al.
5,119,649 A 6/1992 Spence
5,135,197 A 8/1992 Kelley et al.
5,138,785 A 8/1992 Paterson
5,146,769 A 9/1992 Smith
5,154,456 A 10/1992 Moore
5,184,798 A 2/1993 Wilson
5,197,706 A 3/1993 Braithwaite et al.
5,223,815 A 6/1993 Rosenthal et al.
D337,040 S 7/1993 Carl
5,228,319 A 7/1993 Holley et al.
5,279,136 A 1/1994 Perry
5,317,304 A 5/1994 Choi
5,327,752 A 7/1994 Myers et al.
D350,473 S 9/1994 Simon
5,349,834 A 9/1994 Davidge
5,349,835 A 9/1994 Liao
5,351,507 A 10/1994 Derman
5,351,508 A 10/1994 Kelley
5,361,610 A 11/1994 Sanders
5,370,488 A 12/1994 Sykes
5,377,512 A 1/1995 Kelley
5,381,685 A 1/1995 Carl et al.
5,390,514 A 2/1995 Harmon
5,390,977 A 2/1995 Miller
5,394,713 A 3/1995 Harmon
5,397,171 A 3/1995 Leach
5,398,530 A 3/1995 Derman
5,400,622 A 3/1995 Harmon
5,406,809 A 4/1995 Igelmund
5,412,959 A 5/1995 Bentley
5,421,667 A 6/1995 Leyden et al.
5,447,045 A * 9/1995 Cheng ..... 70/58
5,447,049 A 9/1995 Shien
5,466,022 A 11/1995 Derman
5,473,917 A 12/1995 Say
5,489,173 A 2/1996 Hofle
5,493,878 A 2/1996 Murray et al.
5,502,989 A 4/1996 Murray, Jr. et al.
5,520,031 A 5/1996 Davidge
D370,473 S 6/1996 Derman
5,548,981 A 8/1996 Kirk
5,570,080 A 10/1996 Inoue et al.
5,579,657 A 12/1996 Makous
5,593,878 A 1/1997 Knopf et al.
5,603,416 A 2/1997 Richardson et al.
5,608,605 A 3/1997 Siow et al.
5,610,587 A 3/1997 Fujiuchi et al.
5,611,223 A 3/1997 Spitzer
5,622,064 A 4/1997 Gluskoter et al.
5,687,592 A 11/1997 Penniman
5,692,400 A 12/1997 Bliven et al.
5,709,110 A 1/1998 Greenfield et al.
5,722,268 A 3/1998 Choi
5,787,738 A 8/1998 Brandt et al.
5,787,739 A 8/1998 Derman
5,791,171 A 8/1998 Kelley
5,794,463 A 8/1998 McDaid
5,799,520 A 9/1998 Laabs et al.
5,836,183 A 11/1998 Derman
5,870,281 A 2/1999 Kim
5,875,657 A 3/1999 Kelley
5,884,508 A 3/1999 Dwight
5,889,463 A 3/1999 Judd et al.
5,913,907 A 6/1999 Lee
5,960,651 A 10/1999 Tanisawa
5,963,131 A 10/1999 D'Angelo et al.
5,983,679 A 11/1999 Reyes
5,987,937 A * 11/1999 Lee ..... 70/14
6,000,251 A 12/1999 Murray et al.
6,000,252 A 12/1999 Murray et al.
6,006,557 A 12/1999 Carl et al.
6,038,891 A 3/2000 Zeren et al.
6,058,744 A 5/2000 Ling
6,081,974 A 7/2000 McDaid
6,087,939 A 7/2000 Leyden et al.
6,088,229 A * 7/2000 Seto et al. ..... 361/726
6,112,561 A 9/2000 Carl
6,112,562 A 9/2000 Murray, Jr. et al.
6,125,669 A 10/2000 McDaid et al.
6,133,830 A 10/2000 D'Angelo et al.
6,150,940 A 11/2000 Chappman et al.
6,155,088 A 12/2000 Murray, Jr. et al.
6,170,304 B1 * 1/2001 Ohta ..... 70/14
6,170,364 B1 1/2001 Johnson
6,173,591 B1 1/2001 Derman
6,199,413 B1 3/2001 McDaid et al.
6,205,824 B1 3/2001 Miao
6,212,918 B1 4/2001 Kravtin
6,227,017 B1 5/2001 Igelmund
6,244,080 B1 6/2001 Sakurai
6,244,082 B1 6/2001 Avganim
6,257,029 B1 7/2001 Liao
6,262,664 B1 7/2001 Maloney
6,265,974 B1 7/2001 D'Angelo et al.
6,275,378 B1 * 8/2001 Lee et al. ..... 361/679.55
6,300,874 B1 10/2001 Rand
6,301,940 B1 10/2001 Derman et al.
6,317,936 B1 11/2001 McDaid et al.
6,360,405 B1 3/2002 McDaid et al.
6,389,853 B1 * 5/2002 Pate et al. ..... 70/18
6,389,854 B1 5/2002 Huang
6,401,502 B1 6/2002 Yang
6,427,499 B1 8/2002 Derman
6,442,984 B1 9/2002 Katoh et al.
6,449,992 B1 9/2002 Yu
6,463,770 B1 * 10/2002 Lee ..... 70/58
6,513,350 B1 2/2003 Hurd et al.
6,553,794 B1 4/2003 Murray, Jr. et al.
6,588,241 B1 7/2003 Murray, Jr. et al.
6,591,642 B1 7/2003 Kuo
6,598,433 B1 7/2003 Malvasio
6,619,080 B1 9/2003 Yu
6,619,081 B1 9/2003 Yu
6,621,415 B1 9/2003 Willis
6,735,990 B1 5/2004 Murray, Jr. et al.
6,758,069 B2 7/2004 Derman
6,763,688 B1 7/2004 Syu
6,763,690 B2 7/2004 Galant
6,788,216 B2 * 9/2004 Chen ..... 340/693.5
6,886,376 B2 5/2005 Kuo
6,933,847 B2 8/2005 Feibelman

| | | | | |
|---|---|---|---|---|
| 6,971,255 | B2 * | 12/2005 | Bhogal et al. | 70/58 |
| 6,973,809 | B2 | 12/2005 | Chang | |
| 7,028,513 | B2 | 4/2006 | Avganim | |
| 7,111,479 | B2 | 9/2006 | Murray, Jr. et al. | |
| 7,121,125 | B2 | 10/2006 | Murray et al. | |
| 7,143,614 | B1 | 12/2006 | Murray et al. | |
| 7,150,168 | B1 | 12/2006 | Kuo | |
| 7,441,426 | B2 * | 10/2008 | Avganim | 70/58 |
| 7,441,431 | B2 | 10/2008 | Weber et al. | |
| 7,562,547 | B2 * | 7/2009 | Avganim | 70/58 |
| 7,836,551 | B2 * | 11/2010 | Hung et al. | 16/319 |
| 7,971,458 | B2 * | 7/2011 | Gilbert | 70/58 |
| 2002/0134119 | A1 | 9/2002 | Derman | |
| 2003/0101778 | A1 | 6/2003 | Carl et al. | |
| 2004/0040350 | A1 | 3/2004 | Derman | |
| 2004/0206138 | A1 | 10/2004 | Murray et al. | |
| 2005/0097930 | A1 | 5/2005 | Moore et al. | |
| 2005/0150262 | A1 | 7/2005 | Murray et al. | |
| 2005/0150263 | A1 | 7/2005 | Murray et al. | |
| 2005/0178173 | A1 | 8/2005 | Kuo | |
| 2005/0236521 | A1 | 10/2005 | Krause et al. | |
| 2006/0107073 | A1 | 5/2006 | Lane et al. | |
| 2006/0117816 | A1 | 6/2006 | Lee | |
| 2007/0074547 | A1 * | 4/2007 | Wu | 70/58 |
| 2008/0163654 | A1 * | 7/2008 | Avganim | 70/58 |
| 2008/0223090 | A1 * | 9/2008 | Liao | 70/58 |

FOREIGN PATENT DOCUMENTS

| | | | |
|---|---|---|---|
| CA | 791364 | | 8/1968 |
| CA | 987121 | | 4/1976 |
| DE | 329934 | | 12/1920 |
| DE | 335741 | | 4/1921 |
| DE | 361068 | | 4/1923 |
| DE | 456219 | | 2/1928 |
| DE | 577757 | | 8/1932 |
| DE | 3202700 | | 8/1983 |
| DE | 3407723 | A1 | 5/1985 |
| DE | 3824393 | | 7/1989 |
| DE | 20 2004 015 891 | U1 | 1/2005 |
| FR | 455740 | | 8/1913 |
| FR | 877220 | | 12/1942 |
| FR | 1026519 | | 4/1953 |
| FR | 1085107 | | 1/1955 |
| FR | 2308006 | | 11/1976 |
| FR | 2636686 | A1 | 3/1990 |
| GB | 447091 | | 5/1936 |
| GB | 1256295 | | 12/1971 |
| GB | 1376011 | | 12/1974 |
| GB | 2109109 | A | 5/1983 |
| GB | 2234856 | A | 2/1991 |
| HU | P0000398 | | 6/2000 |
| HU | 224329 | | 6/2003 |
| IT | 451949 | | 10/1949 |
| JP | 37-7592 | | 4/1937 |
| JP | 49-91096 | | 11/1947 |
| JP | 52-36813 | | 3/1977 |
| JP | 57-25092 | | 2/1982 |
| JP | 57-179618 | | 11/1982 |
| JP | 2000-140948 | | 5/2005 |
| NO | 14095 | | 5/1905 |
| WO | WO 95/10680 | A1 | 4/1985 |
| WO | WO 86/00396 | A1 | 1/1986 |
| WO | WO 93/15295 | A1 | 8/1993 |
| WO | WO 96/07002 | A1 | 3/1996 |

OTHER PUBLICATIONS

Kensington Product Brochure for Kensington Apple Laser Writer and Macintosh Portable Security Systems, Computer and Office Equipment Security Catalog, 1990, Secure-It, Inc., 18 Maple Court, East Longmeadow, MA 01028.

Apple Security Bracket sold in AS kit.

Retaining Device Incorporated in Apple Computers.

Kensington MicroSaver Computer Lock Box and Literature, 3 pages.

Kensington Product News Release; "Kensington Wins Case Protecting Cable Lock Status", 2003, 1 page.

*ACCO Brands, Inc.* v. *Micro Security Devices, Inc.* Federal Circuit Court Order Granting Defendant's Motion for Summary Judgment, Jul. 23, 2002, 13 pages.

Maltoni, D. et al.; "Handbook of Fingerprint Recognition"; Chapter 1: Introduction, 2003, Springer, New York, pp. 1-52.

Passproof User Manual 1990, 5 pages.

Flexguard Security System, Philadelphia Security Products (no date on page) (1 page).

Los Angeles Times, Jan. 12, 1989, Part V, p. 10.

Kensington Microsaver Packaging and Manual (copyright 1992), 4 pages.

Targus DEFCON 1 Ultra Notebook Computer Security System, User's Guide, copyright 2001.

Targus DEFCON 1 Ultra Notebook Computer Security System; http://www.targus.com/us/product_details.asp?sku=PA400U.

U.S. Patent Reexamination Application No. 90/007,221 filed Sep. 24, 2004.

U.S. Patent Reexamination Application No. 90/007,225 filed Sep. 24, 2004.

U.S. Patent Reexamination Application No. 90/007,674 filed Aug. 19, 2005.

U.S. Patent Reexamination Application No. 95/000,116 filed Nov. 23, 2005.

U.S. Appl. No. 10/970,060, filed Oct. 20, 2004.

U.S. Appl. No. 11/000,397, filed Nov. 29, 2004.

* cited by examiner

SECTION A-A

SECURITY SYSTEM WITH LOCK INTERFACE MEMBER WITH MULTIPLE APERTURES

CROSS-REFERENCES TO RELATED APPLICATIONS

This application is the U.S. National Stage entry of International Application No. PCT/US2008/064382, filed May 21, 2008, which is a non-provisional of and claims the benefit of the filing date of U.S. Provisional Patent Application No. 60/940,318, filed on May 25, 2007, the disclosures of which are herein incorporated by reference in their entirety for all purposes.

BACKGROUND

Embodiments of the invention relate to devices for inhibiting the theft of relatively small but expensive pieces of equipment.

Computers have evolved rather rapidly from large, expensive machines usable only by a few, to relatively small, portable machines which are usable by many. In particular, the development of desk top computers with significant processing power has made computers available to the general population. It is now common for college and even high school students to have their own computer, and desk top computers are in wide spread use as word processors and work stations in almost all forms of business. Desk top computers are relatively small and easily transportable, and an undesirable side effect of their proliferation is the fact that the theft of such computers is a significant problem.

A variety of devices have been developed to inhibit the theft of desk top computers and similar equipment. Since desk top computer systems involve several components, typically including the computer itself, a separate monitor, keyboard and often a printer, such security systems often employ a cable which attaches each of the components to each other and to a relatively immovable object such as a desk. The principal difficulty in such systems is providing an effective and convenient method for attaching the cable itself to the equipment.

One way to address the problem of computer security is to provide a small, generally rectangular slot in a wall of a computer. A security apparatus with a locking head may be secured to the computer via the rectangular slot. While this solution is effective, improvements could be made. For example, although thieves are deterred from stealing portable computers secured by conventional security mechanisms, in some cases, such thieves may be more interested in the data stored in the computers rather than the computers themselves. Accordingly, the damage that may occur to a computer that may occur during the theft of the computer may not deter a thief who wants the data stored inside of the computer. It would be desirable to improve the strength of the physical coupling between the security apparatus and the computer and so that it is more difficult for potential thieves to separate the security apparatus from the computer.

Some lock interface members and security apparatuses that provide for improved strength are described in U.S. Provisional Patent Application No. 60/853,888, filed on Oct. 23, 2006. Some examples described in this application include a lock interface member that is used with a security apparatus comprising an engagement element having a particular configuration. In these examples, each lock interface member is generally configured to engage only one type of engagement element in a specific type of security apparatus. While such lock interface members and security apparatuses are effective, there may be some instances where a different user may have or want to use a different security apparatus for a portable electronic device. It would be desirable to provide for the ability to use different security apparatuses with a single portable electronic device.

Embodiments of the invention address these and other problems, individually and collectively.

BRIEF SUMMARY

Embodiments of the invention are directed to security apparatuses, systems, and methods for using such security apparatuses. Other embodiments of the invention may be directed to lock interface members and systems and methods incorporating such lock interface members.

One embodiment of the invention is directed to a system comprising: a portable electronic device comprising a lock interface member having a first aperture configured to engage with a first security apparatus and a second aperture configured to engage with a second security apparatus; and at least one of the first security apparatus and the second security apparatus engaged with the lock interface member.

Another embodiment of the invention is directed to a method comprising: obtaining a portable electronic device comprising a lock interface member having a first aperture configured to engage with a first security apparatus and a second aperture configured to engage with a second security apparatus; inserting at least a portion of the first security apparatus into the first aperture; and securing the first security apparatus to the lock interface member via the first aperture.

Another embodiment of the invention is directed to a lock interface member comprising: a first aperture configured to engage with a first security apparatus; and a second aperture configured to engage with a second security apparatus.

These and other embodiments of the invention are described in further detail below.

BRIEF DESCRIPTION OF THE DRAWINGS

FIGS. 3(*a*)-3(*c*) respectively show a front, upper perspective view, a rear upper perspective view, and a lower front perspective view of a lock interface member according to an embodiment of the invention. FIGS. 3(*d*)-3(*g*) respectively show a side cross-section view, a front elevation view, a top plan view, and a bottom plan view of a lock interface member according to an embodiment of the invention.

FIG. 4(*b*) shows an exploded view of the security apparatus shown in FIG. 4(*a*).

In the Figures, like numerals designate like elements.

DETAILED DESCRIPTION

Figure 1:
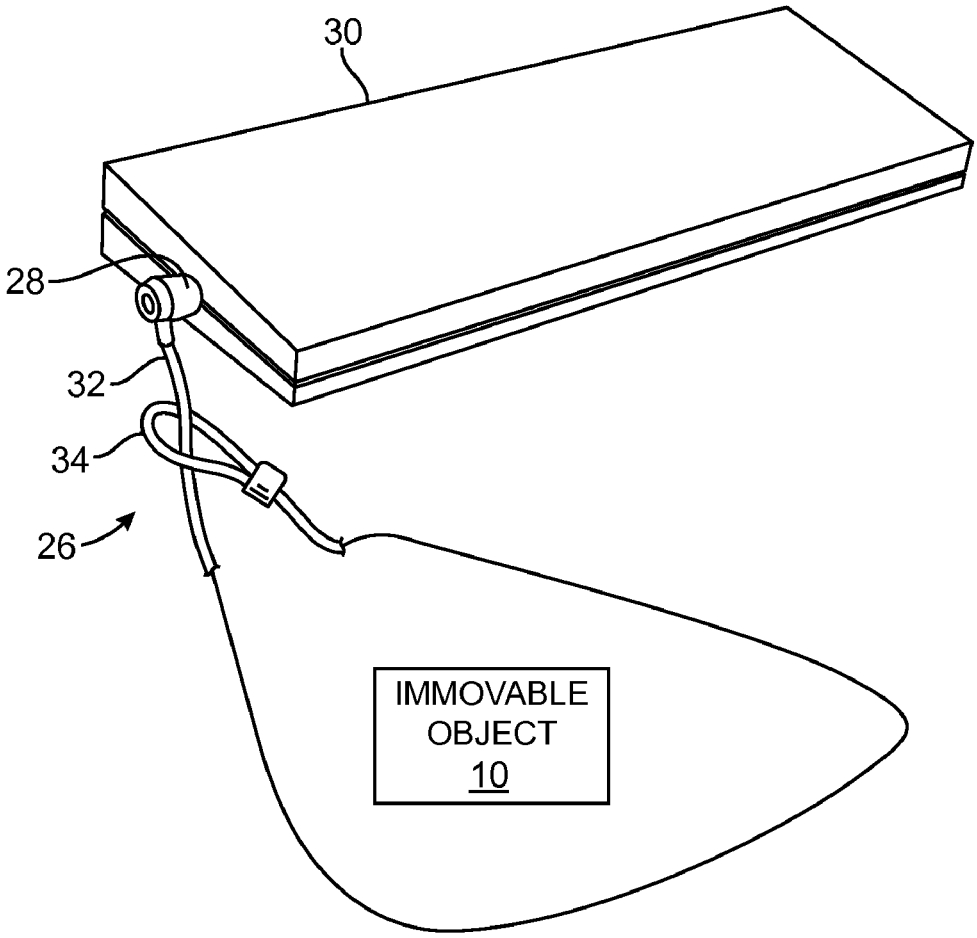
FIG. 1 shows a perspective view of a portable electronic device and a security apparatus.

Embodiments of the invention include systems, methods, and lock interface members. In embodiments of the invention, reference is made to "first" and "second" apertures in a lock interface member, and "first" and "second" security apparatuses. It is understood that embodiments of the invention may include more than two apertures or more than two security apparatuses.

As used herein, in the above described embodiments and in other embodiments, an "aperture" may include a blind aperture or a through aperture. A through aperture may be in the form of a hole, or a recess.

One embodiment of the invention is directed to a system including a portable electronic device including a lock interface member having a first aperture configured to engage with a first security apparatus and a second aperture configured to engage with a second security apparatus. At least one of the first security apparatus and the second security apparatus is engaged with the lock interface member.

The lock interface member may be an attachment that may be attached to the housing of the portable electronic device, or it may be integrally formed in the housing or other component of the portable electronic device. For example, in some embodiments, the lock interface member may be integrally formed with, or operatively or physically coupled to the chassis of the portable electronic device and/or may be operatively or electrically coupled to some electrical component in the portable electronic device. In addition, if the lock interface member is a separate component from the wall of the portable electronic device, the lock interface member may be positioned within an aperture formed in a wall of the portable electronic device, or inside of the portable electronic device. Exemplary lock interface members are described in further detail below. Further, the lock interface members can be made of any suitable material including plastic, steel, or nickel alloys.

The first and second apertures can have first and second configurations, where the first and second configurations are different. First and second engagement elements in the first and second security apparatuses may also have different configurations so that they can respectively engage the first and second apertures. For example, the first aperture may be defined by one or more protrusions in an aperture wall, while the second aperture may be a substantially rectangular slot without protrusions. The first security apparatus may have an engagement element with recesses that are cooperatively configured to be received by the protrusions associated with the first aperture. The second apparatus may have an engagement element which is in the form of a T-bar with a shaft and a cross-member. The cross-member may be rotatable so that it can pass through the second aperture when it is aligned with the second aperture. It can then be rotated about 90 degrees so that it is not aligned with the second aperture and thereafter engages the lock interface member via the second aperture.

In some embodiments of the invention, the first engagement element associated with the first security apparatus can engage the lock interface member via the first aperture, but cannot engage the lock interface member via the second aperture. Also, in such embodiments, the second security apparatus can engage the lock interface member via the second aperture, but cannot engage the lock interface member via the first aperture. The first aperture and the second aperture may be sufficiently close together so that only one type of security apparatus can be used at a time.

In embodiments of the invention, the lock interface member can engage only one of the first and the second security apparatuses, or can engage both of the first and second security apparatuses simultaneously. In this way, at least two different types of security apparatuses can be used with the lock interface member to secure a portable electronic device. If a user only has a security apparatus that is like the first security apparatus, then the user can use the first security apparatus to secure the portable electronic device. If the user only has a security apparatus like the second security apparatus, then the user can use the second security apparatus to secure the portable electronic device.

Also, in some embodiments of the invention, the first and second apertures are only used to interface with physical security apparatuses and to prevent the unauthorized taking and/or use of the portable electronic device. For example, the first and second apertures are typically not used to provide any function for normal operation of the portable electronic device. In some embodiments, electronics that may disable the portable electronic device may be associated with the first and/or second apertures in the lock interface member. If for example, the first security apparatus is used to secure a portable electronic device via a first aperture in a lock interface member, the unauthorized removal of the security apparatus may disable the portable electronic device.

Embodiments of the invention provide for a number of advantages. For example, a user of a portable electronic device including a lock interface member with at least a first and a second aperture may use many different types of security apparatuses, to secure the portable electronic device to an immovable object. The user is not restricted to the use of one type of security apparatus with only one type of engagement element. If, for example, the first aperture in the lock interface member may be adapted to interface with an older security apparatus and the second aperture in the lock interface member may be adapted to interface with a newer security apparatus. If the user decides to upgrade from the older security apparatus to the newer security apparatus, the newer security apparatus can still be used to secure the portable electronic device to an immovable object.

In addition, by using a lock interface member, the strength of the coupling between at least one of the first and the second security apparatuses and the lock interface member can be increased over a conventional physical security system including a portable electronic device comprising a conventional security slot and a physical security apparatus secured to the portable electronic device via the security slot. A conventional security system such as this can withstand 150 lbs of force, because the plastic housing of the portable consumer device can fail or break when this magnitude of force is applied. Also, current locks on the market are designed to withstand 300 lbs of force before they are broken. Improved security apparatuses and systems are therefore desirable.

In some embodiments of the invention, the strength of the coupling between the security apparatus and the portable electronic device may be increased by at least 2, 6, or even 8 times compared to conventional systems. For example, by using embodiments of the invention, it may take more than about 300 lbs of force, or even more than about 500, 1000, or 2000 lbs of force to break the physical coupling between the head in a security apparatus and the portable electronic device to which it is secured. As shown below, the lock interface members of some security apparatuses and the corresponding engagement elements and stabilizing elements are cooperatively structured with each other, and have more contact area than conventional security systems. The engagement elements and the stabilizing elements are also stronger than conventional elements in conventional locks. Accordingly, embodiments of the invention are stronger and therefore more effective at deterring and preventing the theft of portable electronic devices than conventional security systems.

Exemplary security apparatuses are described in detail below. The security apparatuses may comprise a head and a security device. The head and the security device may be physically and/or operationally coupled together.

In an embodiment of the invention, the security device may comprise a cable, or some other type of device to provide security. If the security device comprises a cable, then the cable may be secured to an immovable object such as a desk or cabinet so that a portable electronic device coupled to the cable cannot be removed. The cable may comprise stainless steel, Kevlar®, or some other type of strong material.

In another embodiment, the security device may comprise a wireless device such as a wireless transmitter and/or receiver. The wireless device may be used in a proximity detection system or a motion detection system. For example, a motion detector could be present in the wireless device so that when the motion detector moves, an associated alarm is triggered. The alarm may be in the security device or may be external to the security device. In another embodiment, there may be a base device associated with the wireless device, and these components may be used in a proximity detection system. Wireless signals may be transmitted between the security device and the base device, and when these devices are separated by a predetermined distance, an associated alarm (e.g., an audible alarm) may be triggered. The alarm could be in the base device or in the security device. The electronics associated with such wireless systems are known to those of ordinary skill in the art.

The security apparatus may comprise a head. The head in the security apparatus may be a locking head. A locking head according to an embodiment of the invention may comprise a locking mechanism such as a key locking mechanism or a combination locking mechanism disposed within it. Various types of locking heads are described in further detail below.

The portable electronic device that is to be secured may comprise any suitable device. Examples of such devices comprise portable computers such laptop, desktop, and server computers, flat panel televisions, projectors, monitors, portable music players, printers, external hard-drives, cell phones, etc.

FIG. 1 shows a system comprising a portable electronic device 30 and a security apparatus 26 that is used to secure the portable electronic device 30 to an immovable object 10 such as a desk leg or the like. The security apparatus 26 comprises a head 28 and a cable 32 coupled to the head 28, which may be a locking head in this example. A loop 34 is at a terminal end of the head 28. The cable 32 may comprise a strong material such as stainless steel or Kevlar™.

To secure the portable electronic device 30 to the immovable object, the cable 32 may be wrapped around the immovable object and the head 28 may pass through the loop 34. An engagement element in the head 28 may then be inserted into an aperture in the portable electronic device 30, or in an aperture in a lock interface member that is associated with the portable electronic device 30. A stabilizing element may then be inserted into the aperture in the lock interface member to stabilize the head 28 so that the engagement element cannot be readily withdrawn from the aperture. A locking mechanism such as a key locking mechanism or a combination locking mechanism may be used to keep the stabilizing element and/or the engagement element from moving or not moving. In other embodiments, the stabilizing element may first be inserted into the aperture in the lock interface member, and/or an aperture in the portable electronic device, and the engagement element may thereafter be inserted therein to engage the aperture in the portable electronic device or in the lock interface member.

Figure 2A:
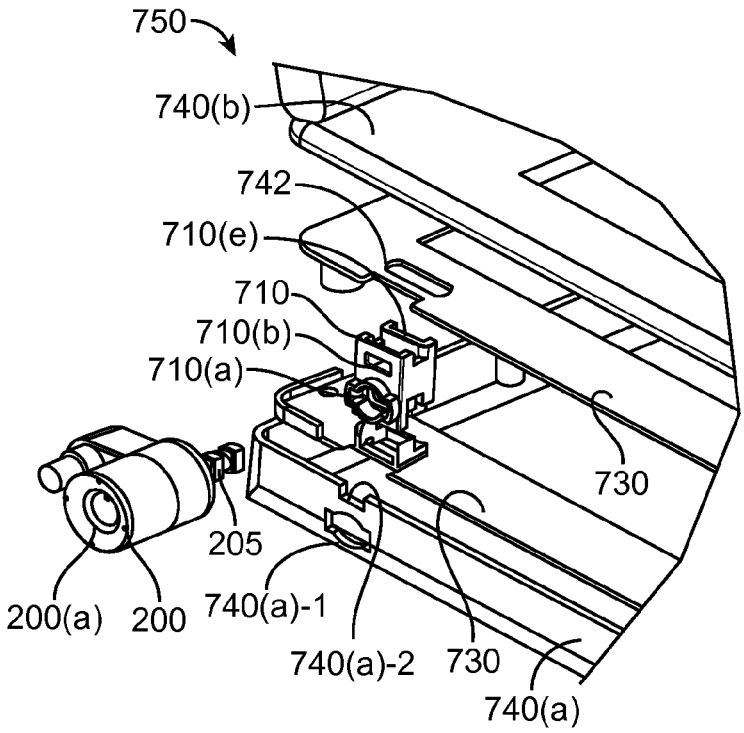
FIGS. 2(*a*)-2(*b*) respectively show an exploded view and a side cross-sectional view of a system according to an embodiment of the invention.
Figure 2B:
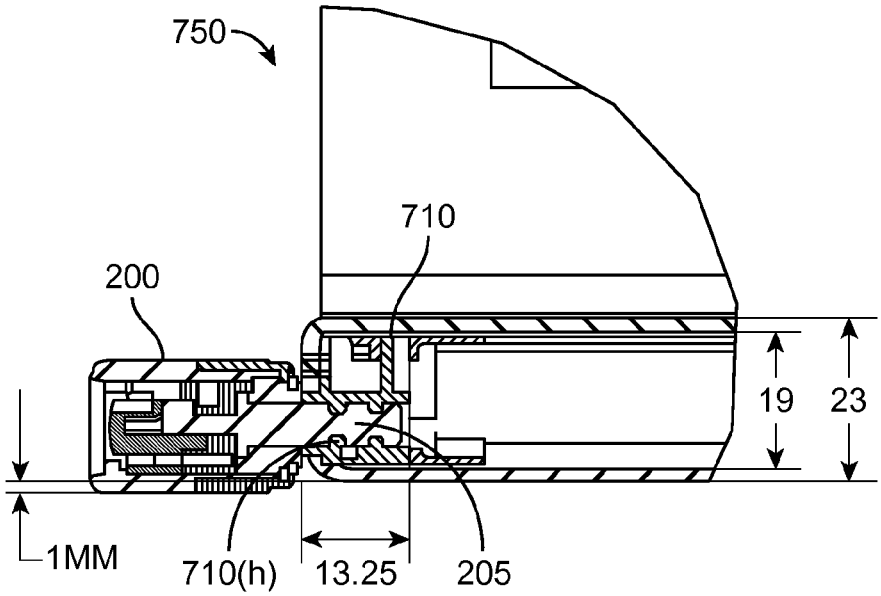
Figure 3A:
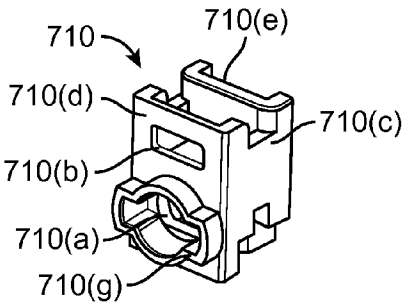
FIGS. 3(*a*)-3(*g*) shows various views of a lock interface member with first and second apertures.
Figure 3B:
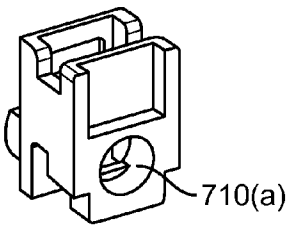
Figure 3C:
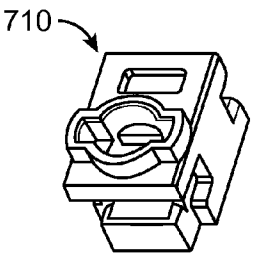
Figure 3D:
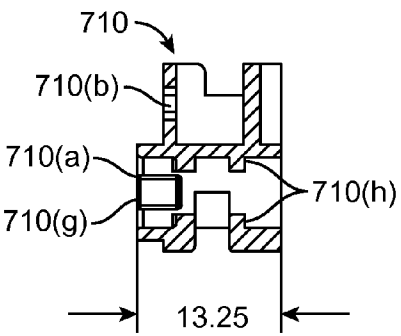
Figure 3E:
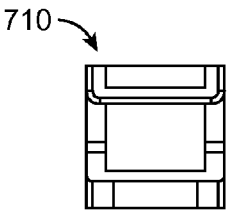
Figure 3F:
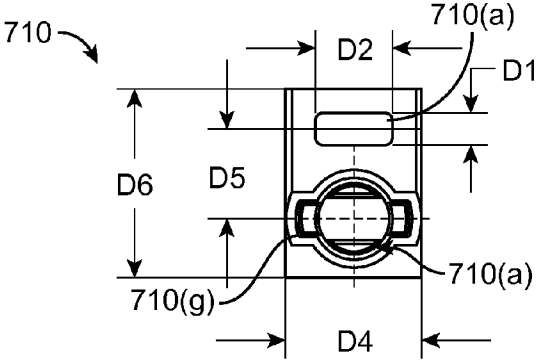
Figure 3G:
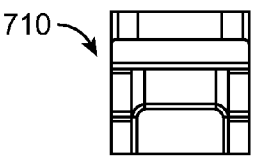

FIG. 2(*a*) is an exploded view of a system according to an embodiment of the invention. The system includes a portable electronic device 750 including internal computer chassis portions 730 sandwiched between external plastic chassis portions 740(*a*), 740(*b*). A lock interface member 710 may be attached to, or integrally formed with, internal computer chassis portions 730 and/or external plastic chassis portions 740(*a*), 740(*b*). The lock interface member 710 comprises a first aperture 710(*a*) and a second aperture 710(*b*) spaced from the first aperture 710(*a*). A hole 740(*a*)-1 may be in the bottom external chassis portion 740(*a*) and may align with the first aperture 710(*a*) in the lock interface member 710. A second hole 742 in an upper internal chassis portion 730 can receive a rear portion 710(*e*) of the lock interface member 710 and can secure the lock interface member 710 thereto.

Figure 4A:
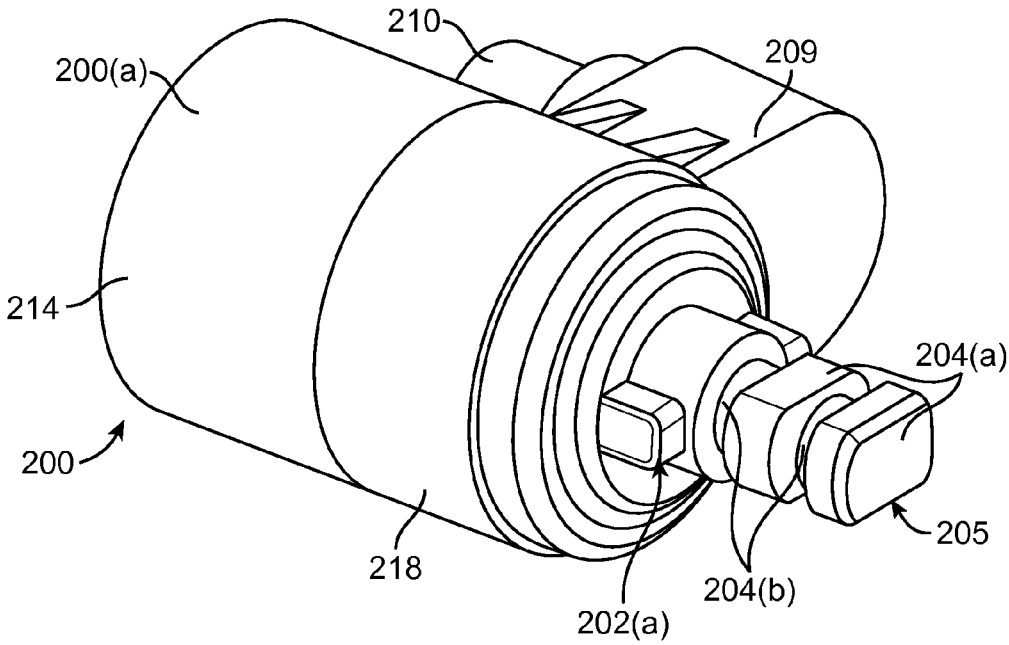
FIG. 4(*a*) shows a front, perspective view of a portion of a security apparatus that can engage a first aperture in a lock interface member.
Figure 4B:
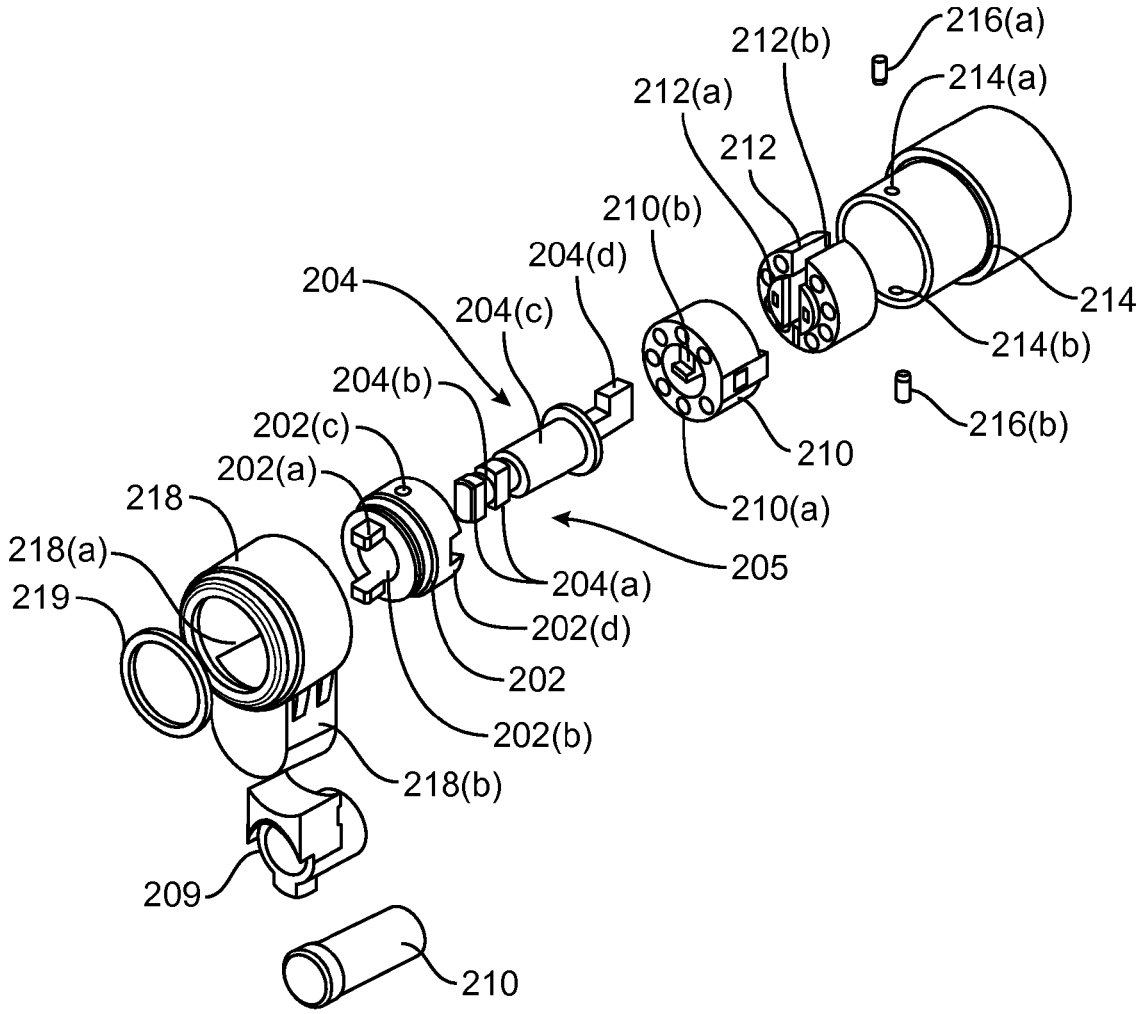

A first security apparatus 200 (which may have a similar configuration as the security apparatus in FIG. 4(*a*)) may interface with the first aperture 710(*a*) in the lock interface member 710. The first security apparatus 200 may comprise a head 200(*a*) comprising an elongated engagement element 205 at one end and a keyway at the other end. Further details regarding the first security apparatus 200 and other security apparatuses are provided below.

As shown in FIG. 2(*b*), in use, an engagement element 205 in the first security apparatus 200 can be inserted into the lock interface member 710 and can pass through the second aperture 710(*b*) in the lock interface member 710 and the hole 740(*a*)-1 in the bottom external chassis portion 740(*a*) when it is aligned with them. The elongated engagement element 205 can be removable from the second aperture 710(*b*) when the security apparatus 200 is in an unlocked configuration, and may not be removable when the security apparatus 200 is in a locked configuration. Stabilizing elements (e.g., pins), which are not shown in FIGS. 2(*a*)-2(*b*), may also extend axially outward in the same direction as the engagement element 205. The stabilizing elements may be used to secure the security apparatus 200 to the portable electronic device 750 when the engagement element 205 is in a locked configuration, so that the security device 200 cannot be separated from the portable electronic device 750.

As shown in FIG. 2(*b*), the first security apparatus 200 may comprise an engagement element 205 that has recesses that engage inward protrusions 710(*h*) in the first aperture 710(*a*) in the lock interface member 710. The security apparatus 200 may also include a cable (not shown) so that the security apparatus 200 can secure the portable electronic device 750 to some other object.

FIGS. 3(*a*)-3(*g*) shows various views of a lock interface member with first and second apertures.

FIGS. 3(*a*)-3(*b*) show a lock interface member 710 comprising a body 710(*c*) comprising a first aperture 710(*a*) and a second aperture 710(*b*). The first aperture 710(*a*) may be cooperatively structured to receive an engagement element associated with one type of security apparatus, while the second aperture 710(*b*) may be configured to receive an engagement element of another type of security apparatus. The lock interface member 710 also comprises a front portion 710(*d*) and a rear portion 710(*e*) (in the form of vertical walls).

Referring to FIG. 3(*d*), the first aperture 710(*a*) may comprise axial protrusions 710(*h*) and stabilizing element receiving recesses 710(*g*). As shown in FIG. 3(*f*), the first aperture 710(*a*) may have a circular shape with radially extending recesses 710(*b*). Also, the second aperture 710(*b*) has a different configuration than the first aperture 710(*a*). For example, in this example, the second aperture 710(*b*) may be in the form of a generally rectangular slot that has dimensions of about 3 mm by about 7 mm. It may engage security apparatuses like those described in U.S. Pat. No. 6,006,557, which is herein incorporated in its entirety for all purposes. By using at least two different apertures configured to receive at least two different security apparatuses, embodiments of the invention can be adapted to attach to different types of security apparatuses.

FIG. 4(*a*) shows a front perspective view of an exemplary first security apparatus 200 according to an embodiment of the invention. The first security apparatus 200 comprises a head 200(*a*) comprising a body 214 attached to a cable ring 218. A ferrule holder 209 and a ferrule 210 are attached to the cable ring 218.

The security apparatus 200 comprises an engagement element 205 that is rotatable and comprises a number of cross-members 204(*a*) and depressions 204(*b*) formed between the cross-members 204(*a*). The engagement element 205 may also be characterized as having alternating wider cross-member portions and narrower axial shaft portions. Two stabilizing elements 202(*a*) are on opposite sides of the engagement element 205. The two stabilizing elements 202(*a*) are in the form of stationary pins in this embodiment. In other embodiments, the stabilizing elements 202(*a*) may be retractable or otherwise movable, and the corresponding engagement element may or may not be movable.

FIG. 4(*b*) shows an exploded view of the first security apparatus 200 shown in FIG. 4(*a*). FIG. 4(*b*) shows a body 214 in the form of a cylinder. The body 214 is coupled to an abutment structure 202 via pins 216(*a*), 216(*b*). The pins 216(*a*), 216(*b*) pass through holes 214(*a*), 214(*b*) in the body 214, and holes in the abutment structure 202 (one of which is hole 202(*c*)). The abutment structure 202, in this example, comprises a cylindrical structure 202(*d*) with stabilizing elements 202(*a*), 202(*b*) in the form of pins extending axially from the cylindrical structure 202(*d*).

A locking mechanism comprising a first fixed cylinder 210 and a second rotatable cylinder 212 are inside of the body 214. The first fixed cylinder 210 comprises a plurality of axially extending holes 210(*a*) surrounding a central hole 210(*b*). Likewise, the second cylinder 212(*b*) comprises a plurality of axially extending holes 212(*a*) around another central hole 212(*b*).

A locking spindle 204 passes through the central hole 210(*b*) in the first fixed cylinder 210 and is engaged with the second cylinder 212 via its central hole 212(*b*) at its rear end 204(*d*). The locking spindle 204 also includes a central portion 204(*c*) and a front portion which may form the engagement element 205. The engagement element 205 may comprise cross-members 204(*a*) and depressions 204(*b*) as discussed previously. A snap ring 219, a ferrule holder 209, and a cable ferrule 210 are attached to the cable ring 218 via an extending portion 218(*b*). A hole 218(*a*) is in the cable ring 218.

Referring to FIGS. 3 and 4(*a*)-4(*b*), in operation, the engagement element 205 and the stabilizing elements 202(*a*), 202(*b*) are inserted into the first aperture 710(*a*) in the lock interface member 710. As shown in FIG. 3(*f*), the first aperture 710(*a*) of the lock interface member 206 may have lateral ends which are somewhat rectangularly shaped, and a central portion which has upper and lower curved portions. The rectangularly shaped portions are cooperatively structured with the stabilizing elements 202(*a*), 202(*b*) and may receive them. The rectangular shaped portions may include generally straight sides. After the stabilizing elements 202(*a*), 202(*b*), and the engagement element 205 are inserted into the interface member 710, a key (not shown) is inserted into the rear keyway in the head 200(*a*). The key is then turned and this in turn rotates the engagement element 205 clockwise (or counterclockwise).

Referring to FIGS. 3 and 4(*a*), the rotation of the engagement element 205 causes the cross-members 204(*a*) to fill depressions inside of the lock interface member 710. It also causes the protrusions 710(*h*) inside of the lock interface member 710 to fill depressions between the cross-members 204(*a*). The engagement element 205 is therefore strongly interlocked with the lock interface member 710 so that the head 200(*a*) cannot be separated from the lock interface member 710 and cannot be separated from the portable electronic device 760.

Figure 6:
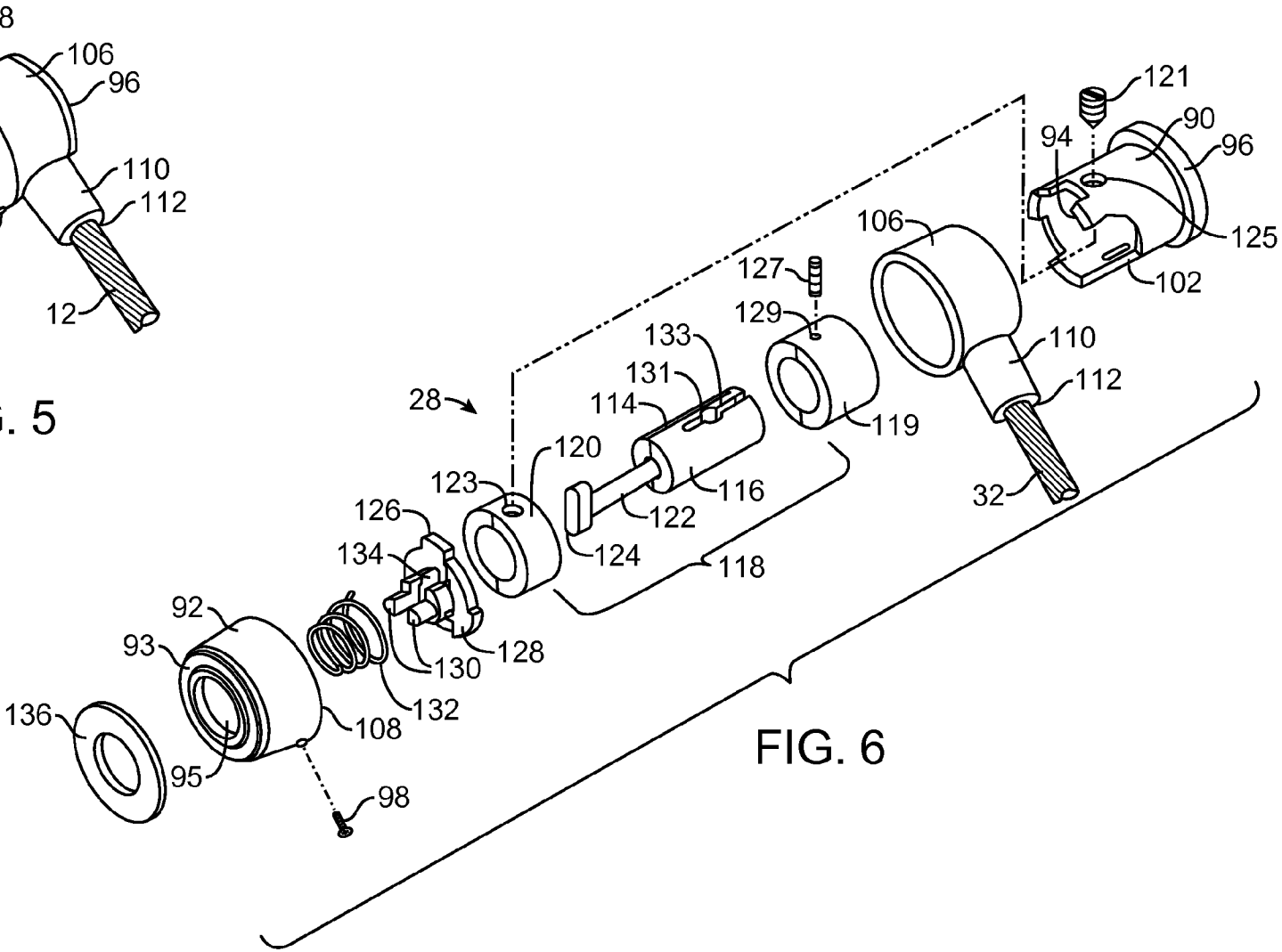
FIG. 6 shows an exploded view of the security apparatus in FIG. 5.
Figure 5:
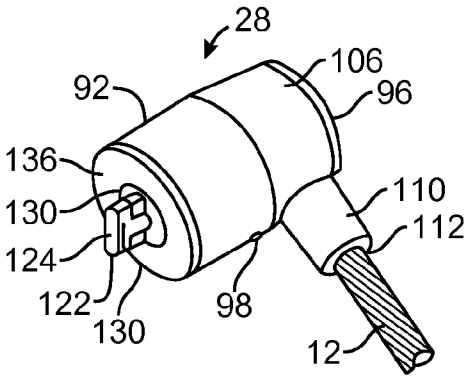
FIG. 5 shows a perspective view of another security apparatus that can engage a second aperture in a lock interface member.

FIG. 5 shows a perspective view of an exemplary second security apparatus including an attachment mechanism 28 in the form of a locking head, and FIG. 6 shows an exploded view thereof. Attachment mechanism 28 includes a hollow shell 92 and a nose-piece 92 which, in combination, form a housing. Shell 90 has a hollow cylindrical interior cavity 94, and an integral apertured plate 96 at one end. A pin 98 is inserted through an aperture (not shown) in nose-piece 92 to engage a slot 102 in shell 90. Pin 98 is designed to shear when torque is applied to nose-piece 92 so that an unauthorized attempt to remove the attachment mechanism will simply shear the pin and allow the nose-piece to freely rotate without degrading the attachment of the attachment mechanism to the component to be protected. Slot 102 is axially elongate so that limited axial movement is allowed between shell 90 and nose-piece 92. The forward end of nose-piece 92 has a plate 93 having a central aperture 95.

A cylindrical collar 106 circumscribes the outer portion of shell 90 and occupies the slot laterally defined by plate 96 and the aft surface 108 of nose-piece 92. Collar 106 has an integral tab 110 with an aperture 112 adapted to receive one end of cable 32. Cable 32 is dead-ended into tab 110 and attached so that it cannot be removed.

A spindle 114 has a cylindrical portion 116 adapted to be received within a cylindrical lock 118 in shell 90. Cylindrical lock 118 includes a front cylinder 119, and a back cylinder 120. A blunt pin or set screw 121 is inserted through an aperture 125 in shell 90, and through a corresponding aperture 123 in back cylinder 120, to lock the front cylinder rotationally with respect to shell 90. Correspondingly, pin or set screw 127 engages a relatively smaller aperture 129 in front cylinder 119, and a widening 131 in slot 133 in the cylindrical portion 116 of spindle 114. Front cylinder 119 is thus fixed rotationally with respect to spindle 114.

As with conventional cylindrical locks, a plurality of pins normally span the interface between front cylinder 119 and back cylinder 120 so that the cylinders are rotationally locked together, thus preventing relative rotation between locking shell 90 and spindle 114. However, a key (not shown) is insertable through the apertured plate 96 of shell 90 to engage front cylinder 119. The correct key can have bosses located to depress the pins passing between cylinders 119 and 120 so that such pins do not span the interface between the cylinders, allowing the cylinders to rotate with respect to one another. In this fashion, spindle 114 can be rotated with respect to shell 90 only upon insertion and rotation of the appropriate key.

Spindle 114 also includes a shaft 122, and a crossmember 124 at the free end of the shaft. An abutment mechanism 126 has an abutment plate 128 adapted to fit within nose-piece 92, and a pair of pins 130 adapted to extend outwardly through aperture 95. A spring 132 is located between abutment plate 128 and nose-piece 92 to bias the cylindrical portion 116 of spindle 114 and the abutment plate rearwardly. Abutment plate 126 has an elongate aperture 134 which allows cross-member 124 to extend through the aperture plate. A plastic bushing 136 is fixed to the surface of plate 93 so that the mechanism does not scar the equipment to which it is attached.

Referring to FIGS. 3 and 5, the operation of the second security apparatus can be described. The shaft 122 and the crossmember 124 can be rotated so that the crossmember 124 is aligned with the pins 130. At this point, the crossmember 124 and the pins 130 can be inserted into the second aperture 710(*b*) in the lock interface member 710. The cross-member 124 then lies past an internal wall of the lock interface member 710. The crossmember 124 can then be rotated so that it is no longer aligned with the second aperture 710(*b*) and the pins 130. At this point, the second security apparatus is then secured to the lock interface member 710 and therefore to the portable electronic device including the lock interface member 710.

Figure 7:
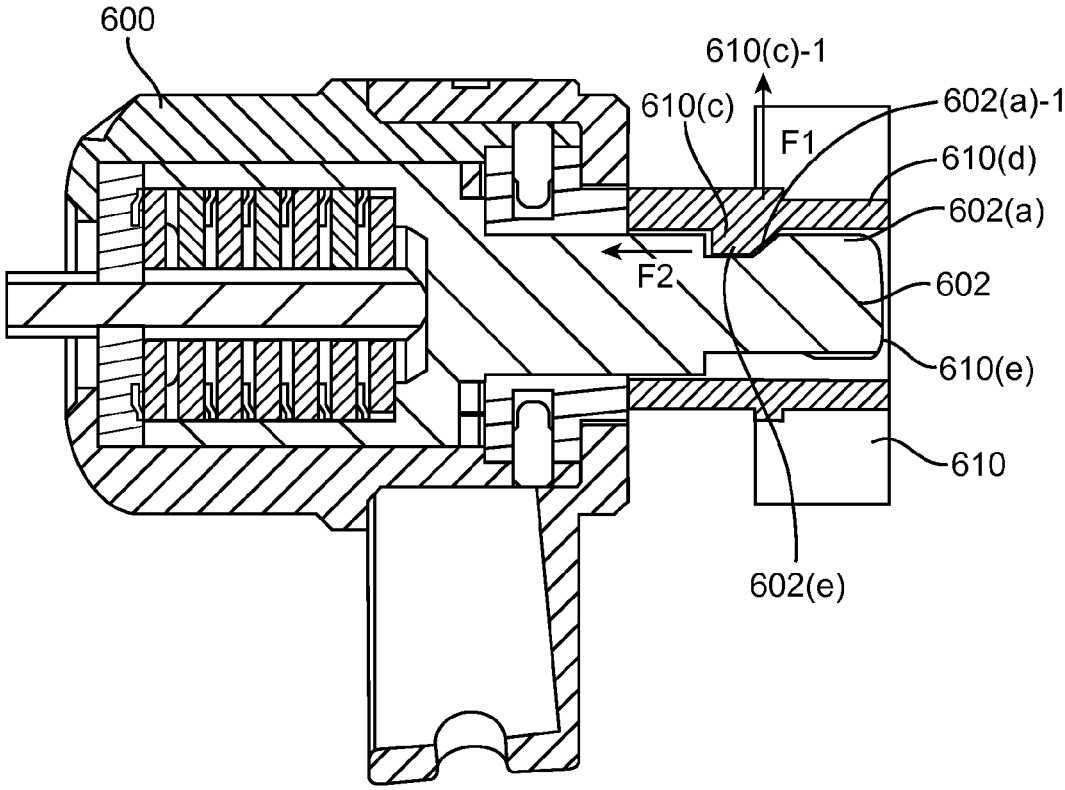
FIG. 7 shows a side, cross-sectional view of another security apparatus according to an embodiment of the invention.

It is understood that the first and second security apparatuses described above are examples, and that other types of security apparatuses and lock interface member apertures can be used in embodiments of the invention. For example, FIG. 7 shows another example of an aperture in a lock interface member and another example of a security apparatus that works with the aperture. This aperture/security apparatus combination could be used instead of or in addition to the previously described first aperture/first security apparatus or second aperture/second security apparatus combination.

As noted above, FIG. 7 shows a cross-sectional view of another system including a security apparatus 600 and the lock interface member 610. FIG. 7 shows the shape of a protrusion 610(*c*) and an engagement element 602. As shown, the protrusion 610(*c*) has a sloped surface 610(*c*)-1 which can interface with a corresponding sloped surface 602(*a*)-1 on the protrusion 602(*a*) on the engagement element 602. The sloped surface 610(*c*)-1 and the sloped surface 602(*a*)-1 may form a 45 degree angle (or more or less than this) with the axis of the engagement element 602. The protrusion 610(*c*) fits into a gap 602(*e*) defined by the outer surface of the engagement element 602. It is understood that although a protrusion 610(*c*) with a sloped surface 610(*c*)-1 is shown in the security system in FIG. 8(*d*), this feature may be used in any of the previously described embodiments as well. In other embodiments, the surfaces 610(*c*)-1 and 602(*a*)-1 need not be sloped, but could be perpendicular to the axis of the engagement element 602.

The engaged, opposing sloped surfaces 610(*c*)-1, 602(*a*)-1 improve the strength of the bond between the security apparatus 600 and the lock interface member 610. For example, if one tries to disengage the security apparatus 600 and the lock interface member 610 by pulling the security apparatus 600 in the direction F2, the engaged, opposing sloped surfaces 610(*c*)-1, 602(*a*)-1 cause any force to be applied to the lock engagement member 610 in a radial direction (e.g., in the direction F1) as well as in an axial direction (e.g., in the direction F1). Since there is a plurality of such slanted surfaces on corresponding lobe/protrusion pairs, any pulling forces can be evenly distributed around the engagement element 602. If the protrusion 610(*c*) had a flat surface perpendicular to the axis of the engagement element 602, then the protrusion 610(*c*) would bear substantially all of the force applied in the axial direction (e.g., direction F2), thereby subjecting protrusion 610(*c*) to a greater amount of force and increasing the likelihood that protruding portion 610(*c*) might break.

The particular security apparatus/aperture configuration shown in FIG. 7 is advantageous, as it is stronger than conventional security apparatus/aperture combinations. This is explained in detail in PCT/US07/82113, filed on Oct. 22, 2007, which is herein incorporated by reference in its entirety for all purposes.

Some embodiments of the invention are also directed to methods of use. One embodiment includes obtaining a portable electronic device comprising a lock interface member having a first aperture configured to engage with a first security apparatus and a second aperture configured to engage with a second security apparatus, inserting at least a portion of the first security apparatus into the first aperture, and securing the first security apparatus to the lock interface member via the first aperture. In some embodiments, the method may include removing the first security apparatus from the lock interface member, inserting at least a portion of the second security apparatus into the second aperture, and securing the second security apparatus to the lock interface member via the second aperture. In such embodiments, different security apparatuses can be used with the lock interface member.

The above description is illustrative and is not restrictive. Many variations of the invention will become apparent to those skilled in the art upon review of the disclosure. The scope of the invention should, therefore, be determined not with reference to the above description, but instead should be determined with reference to the pending claims along with their full scope or equivalents.

One or more features from any embodiment may be combined with one or more features of any other embodiment without departing from the scope of the invention.

A recitation of "a", "an" or "the" is intended to mean "one or more" unless specifically indicated to the contrary.

All patents, patent applications, publications, and descriptions mentioned above are herein incorporated by reference in their entirety for all purposes. None is admitted to be prior art.

What is claimed is:

1. A method comprising:

obtaining a portable electronic device comprising a lock interface member having a first aperture configured to engage with a first security apparatus and a second aperture configured to engage with a second security apparatus;

inserting at least a portion of the first security apparatus into the first aperture;

securing the first security apparatus to the lock interface member via using the first aperture; and locking the first security apparatus.

2. The method of claim 1 wherein the portable electronic device is a computer.

3. The method of claim 1 wherein the first security apparatus comprises a cable.

4. A method comprising:

obtaining a portable electronic device comprising a lock interface member having a first aperture configured to engage with a first security apparatus and a second aperture configured to engage with a second security apparatus;

inserting at least a portion of the first security apparatus into the first aperture; and securing the first security apparatus to the lock interface member using the first aperture, wherein only one of the first security apparatus and the second security apparatus can engage with the lock interface member at a time.

5. A method comprising:

obtaining a portable electronic device comprising a lock interface member having a first aperture configured to engage with a first security apparatus and a second aperture configured to engage with a second security apparatus;

inserting at least a portion of the first security apparatus into the first aperture;

securing the first security apparatus to the lock interface member using the first aperture;

removing the first security apparatus from the lock interface member;

inserting at least a portion of the second security apparatus into the second aperture; and securing the second security apparatus to the lock interface member using the second aperture.

6. A chassis for a portable electronic device comprising a lock interface member, wherein the lock interface member comprises a first aperture configured to engage with a first security apparatus, and a second aperture configured to engage with a second security apparatus, wherein the first aperture and the second aperture are spaced sufficiently close together such that only one of the first security apparatus and the second security apparatus can be secured to the lock interface member at a time.

* * * * *